United States Patent [19]

Oxyer

[11] 3,991,969

[45] Nov. 16, 1976

[54] FORM POSITIONING APPARATUS

[76] Inventor: Ronald A. Oxyer, 10262 Mills Station Road, Rancho Cordova, Calif. 95670

[22] Filed: Nov. 26, 1975

[21] Appl. No.: 635,759

[52] U.S. Cl. ..... 249/20; 249/10; 425/65

[51] Int. Cl.[2] ..... E02B 1/00

[58] Field of Search ..... 425/63, 65; 249/10, 249/19, 20, 21, 22, 23, 24, 25

[56] References Cited

UNITED STATES PATENTS

| | | | |
|---|---|---|---|
| 2,620,543 | 12/1952 | Scharsach | 425/65 |
| 3,583,666 | 6/1971 | Horstketter | 249/10 |

FOREIGN PATENTS OR APPLICATIONS

| | | | |
|---|---|---|---|
| 751,718 | 2/1933 | France | 249/10 |
| 1,162,982 | 4/1958 | France | 249/10 |
| 902,188 | 1/1954 | Germany | 249/10 |
| 460,665 | 12/1950 | Italy | 249/10 |

*Primary Examiner*—J. Howard Flint, Jr.
*Attorney, Agent, or Firm*—Charles F. Duffield

[57] ABSTRACT

Form positioning apparatus is disclosed which maintains flat forms in place for continuously pouring of concrete walled structures. The apparatus utilizes a jacking I beam upon which are positioned a pair of moving beams carried along the flange of the I beam by rollers and each of which supports a compression beam actuated through pivoted levers to secure the flat form panel against the opposite flange of the I beam. A series of jacking dogs cooperating with a jack and ratchet move and lock the moving beam along the jacking beam. Beam deflecting means operating through the moving beams deflect the jacking beam to the required wall curvature.

3 Claims, 5 Drawing Figures

FORM POSITIONING APPARATUS

BACKGROUND OF INVENTION

The construction of thin concrete walled structures such as hyperbolic cooling towers requires that the walls forming the structure be poured as a continuous unit. This is accomplished by forming one level or lift to be poured and pouring that level around the entire circumference of the structure. Thereafter, the forms are moved upwardly for the next lift which is poured as a continuous or integral part of the lower lift and so on until the entire height of the structure has been poured.

There are many different ways in practice for forming the repeated lifts necessary to pour an entire structure. In one method, scaffolding is built upon the ground and each successive lift requires additional scaffolding and forming, all of which is supported upon the lower levels of scaffolding for the entire height of the structure. In another method, no ground engaging scaffolding is employed but, instead, the concrete wall of the lift below is utilized as the supporting medium for apparatus extending above which secures the form for the next lift in place. It is this latter self-supporting forming apparatus to which the improvements of the present invention apply.

In the self-supporting type forming apparatus, a plurality of jacking beams are secured through anchor bolts, to the lower and most recently poured lift around the entire outer circumference of the structure. The upper portion of the I beam extends above the lift poured below. A pair of moving beams spaced on the outer flange of the jacking beam operating through a jack and ratchet arrangement permit the moving beams to jack the apparatus upwardly on dogs along the jacking beam until the height of the next desired lift or pour is reached. At that point, forming material is positioned between adjacent jacking apparatus and held in place against the inner surface of the inner flange of the jacking beam by a compression beam carried by the moving beams. A similar plurality of form positioning apparatus and associated jacking beams are positioned around the entire inner circumference of the structure to provide the required form cavity for the lift to be poured.

After all forms are in place, both on the inside and outside circumference of the structure, the lift will be poured as a continuous lift around the entire circumference. While this is being done, additional anchor bolts are placed in the pour between adjacent form pouring apparatus. After the concrete is set and the forms removed, these anchor bolts will be used to position a further set of I beams which will extend above the top of the pour a distance equal to the next pour to be made. These I beams will match at their lower ends with similar I beams anchored into the lift below and upon which are positioned identical form pouring apparatus used for that lift. The lower set of form pouring apparatus will then be jacked upwardly from one beam onto the next until it has reached the level of the next pour. In this way, alternate sets of form pouring apparatus are utilized to pour the entire structure.

In the self-supported form positioning apparatus currently in use, the force to maintain the form in place was created by means of a wedge driven between the compression beam and the structure associated with the moving beam. The wedges have a tendency to work loose and permit the form to be released. Additionally, a very real hazard existed in removing the wedges. Quite often, they will become dislodged and fall from the structure creating a hazard to workers below the forms.

The form positioning apparatus of the type in use additionally employs structure associated with the moving beams to deflect the jacking beam either inwardly or outwardly. In such devices as a hyperbolic cooling tower, the forms must be slightly curved in each lift to provide the overall curvature of the structure through the many lifts required to pour the structure.

In one mode of beam deflection in the apparatus currently in use, the top rollers on the lower ends of the moving beams are forced downwardly against the outer edges of the outer flange of the jacking beam. This condition results in great stress being placed on the outer edges of the outer flange with consequent bending or cracking of the flanges. The jacking beams are usually made of aluminum and are very costly to replace.

OBJECTS AND SUMMARY OF INVENTION

It is an object of the present invention to provide improvements to form positioning apparatus of the type heretofore known in which the hazard and impracticability of wedges between the moving beam and compression beam is replaced by a positive acting and lockable compression force.

It is a further object of the present invention to provide improvements to form positioning apparatus of the type heretofore known which eliminates cracking and distortion of the outer beam flanges by the roller associated with the moving beams.

In accordance with the present invention, the compression beam is altered in its attachment to the moving beam for relative movement by means of vertical slots and pins. Four compression levers are pivotally connected at each end of the two moving beams and pivotally interconnected to the compression beams in a manner such that pivoting of the compression levers will retract or extend the compression beam into engagement with the form positioned on the inner surface of the inner jacking beam flange.

Further in accordance with the present invention, an upwardly curved dog compression plate is positioned upon the axle positioned between the two upper rollers on the lower end of the moving beams. The compression dog is of a thickness approximating or slightly in excess of the distance between the axle and the upper surface of the jacking dogs such that, during deflection of the beam in that mode, the dog compression plate will bear upon the upper surface of the jacking dog rather than the force being transmitted through the rollers to the outer edges of the jacking beam flange.

Other objects and advantages of the present invention will become apparent to those skilled in the art from the detailed description thereof which follows taken in conjunction with the drawings.

DETAILED DESCRIPTION OF INVENTION

A. The Prior Art Device

Figure 1:
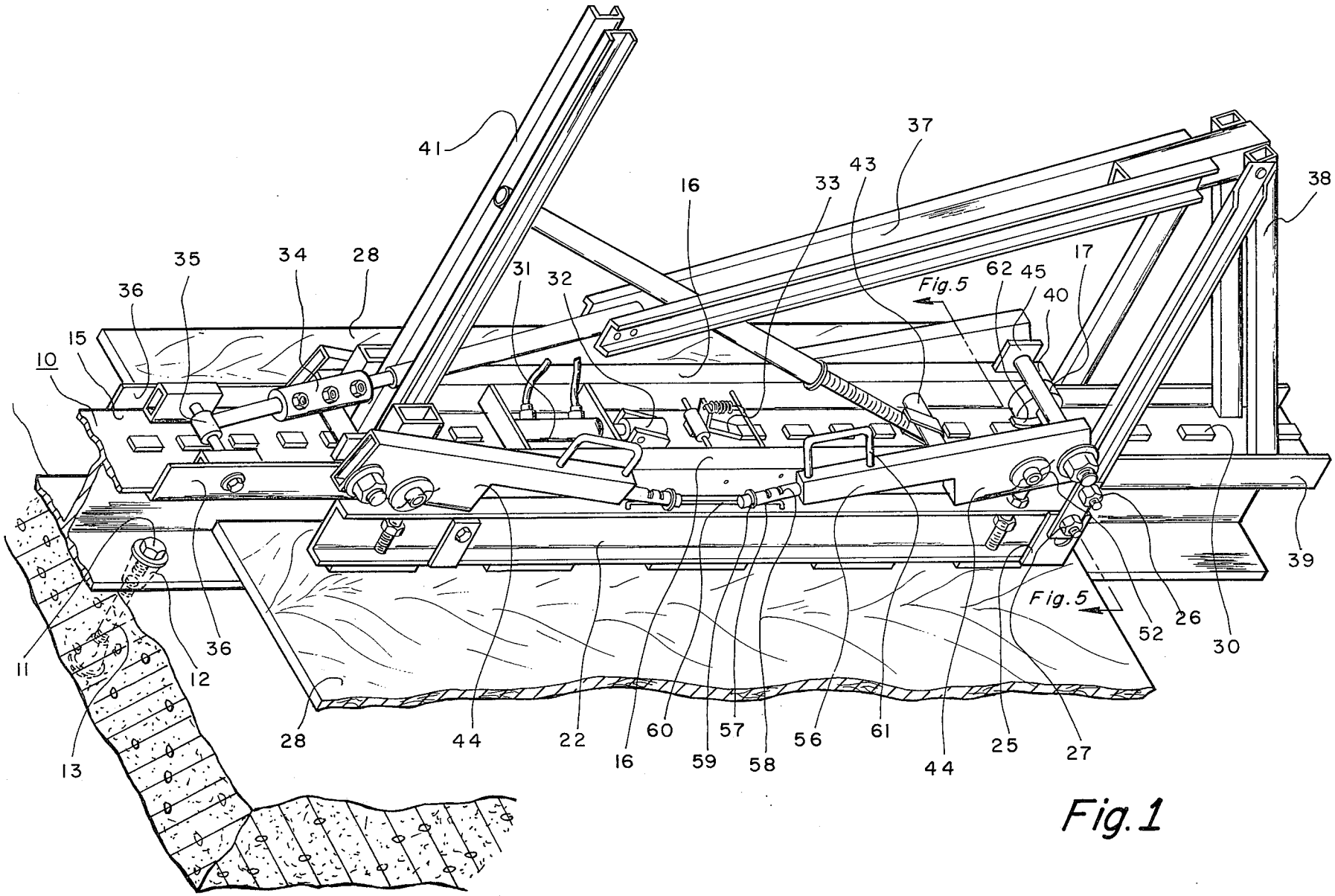
FIG. 1 is a perspective view of the form positioning apparatus of the present invention in place upon a concrete wall.

That portion of the form positioning apparatus which has been in prior use in the art will be described in this section and, thereafter, the specific improvements thereto forming the present invention will be described in the following section. Reference will be made primarily to FIG. 1 of the drawings and to FIGS. 2 – 5 for specific details.

The prior art form positioning apparatus, as previously indicated, is positioned upon a jacking beam 10 which is secured in place to the concrete wall by means of anchor bolts 11, which thread into a cone 12 which, in turn, thread into a bolt 13 positioned in the wall. The inner flange 14 of the jacking beam is positioned against the concrete wall and the outer or upper flange 15 provides the support for two opposed parallel moving beams 16.

Figure 5:
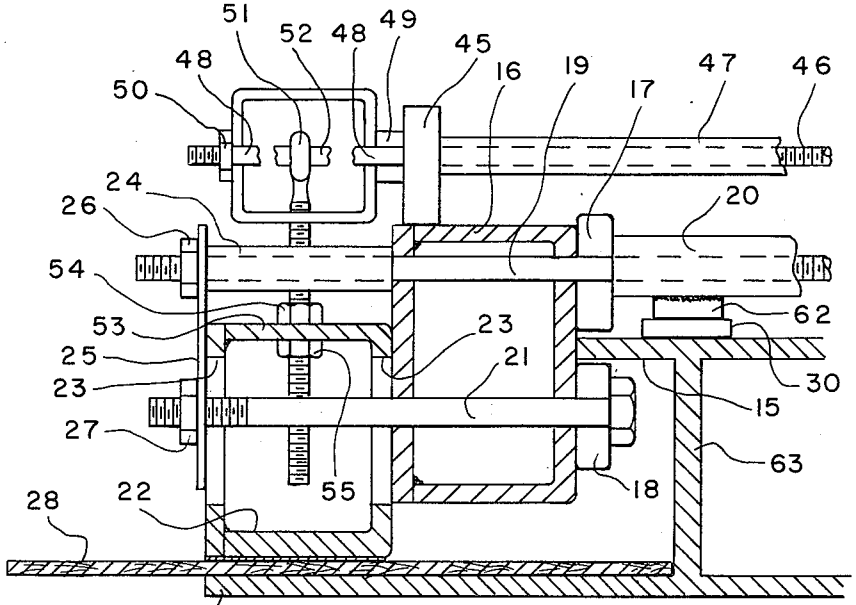
FIG. 5 is an end sectional view of the form positioning apparatus of the present invention taken along the line 5—5 shown in FIG. 1.

As may be seen in more detail in FIG. 5, the moving beam 16 is supported, at either end, upon the outer edge of the outer flange 15 by a pair of rollers 17 and 18 spaced on either side of the flange. An elongate axle bolt 19 passing through the upper rollers and operating in conjunction with a spacer 20 maintains the rollers for each moving beam in place. In a like manner, an axle bolt 21 positioned through the lower portion of the moving beam 16 maintains the lower roller 18 in place.

Each movable beam 16 provides the support for a compression beam 22. The compression beam includes two elongate vertical slots 23 positioned in one end of the beam. The axle bolt 19 extends through the outer wall of the movable beam 16, through a spacer 24 and an end plate 25. The end of the axle bolt 19 is threaded and a nut 26 is brought up against the plate 25 and the spacer 24 to secure the upper end of the plate.

The axle bolt 21 passing through the lower portion of the movable beam 16 extends through the vertical slots 23 and an aperture in the lower end of end plate 25 wherein it is secured by means of a nut 27. In this manner, the compression beam 22 may move vertically with respect to the movable member 16 such that it comes to bear against the form board 28 positioned against the inner surface of the inner flange 14. In the device as heretofore known, the compressive force was created by means of a wedge driven between the spacer 24 and the upper surface of the compression beam 22.

The opposite end of each of the movable beams and compression beams are similarly structured in the devices as heretofore known to provide vertical relative movement between the compression beam and the movable beam. The wedging action is likewise the same. However, in accordance with the present invention, certain alterations to the structure have been made such that the vertical slots are provided in the side of the movable beam and the guide pin for the slot is a bolt positioned through the walls of the compression member.

Returning to FIG. 1, the jacking beam 10 employs a plurality of jacking dogs 30 spaced vertically along the central axis of the jacking beam. The jacking dogs cooperate with a hydraulic jack 31 which operates through a ratchet head 32 and ratchet lock 33 to vertically move and lock the movable guide members along the jacking beam 10.

Deflection of the jacking beam and consequent deflection of the forms to create the required form curvature is accomplished in the device as heretofore known by means of a two-way hydraulic jack 34 which is anchored at one end 35 into extended tail pieces 36 extending from the movable guide beams and interlocked for sliding engagement with the upper flange 15 of the guide beam 10. The opposite end of the hydraulic jack 34 extends into an elongate beam deflection arm 37 which terminates, at its opposite end, into a triangular beam deflection truss 38. The beam deflection truss 38, at its lower end, is interlocked into similar tail pieces 39 secured to the movable beams at their ends. The interconnection of the movable tail pieces 39 and the lower ends of the deflection truss 38 provide a sliding interconnection with the upper flange 15 of the jacking beam 10.

Whenever the hydraulic jack 34 is extended, the force through the beam deflection arm 37 and applied to the deflection truss 38 causes the entire beam and form associated therewith to deflect in a convex configuration. The opposite energization of the hydraulic cylinder 34 will retract the beam deflection arm and operate through the deflection truss 38 to bear down upon the lower ends 40 of the movable beams to cause the entire beam to deflect in a concave configuration. In this mode of deflection, the force of the deflection is passed from the lower ends 40 of the moving beams 16 to the spaced upper rollers 17 which, in turn, apply the deflection force to the outer edges of the upper or outer flange 15. It is this force which has heretofore caused cracking or breaking of the flange sections.

The form positioning apparatus shown in FIG. 1 also includes a scaffolding support 41 pivoted at one end to the upper portion of the apparatus. A scaffolding support jack 42 interconnected between the outer end of the scaffolding support 41 and a pivot pin 43 positioned between the two movable beams provides a leveling adjustment for the scaffolding support 41.

B. The Invention

Figure 2:
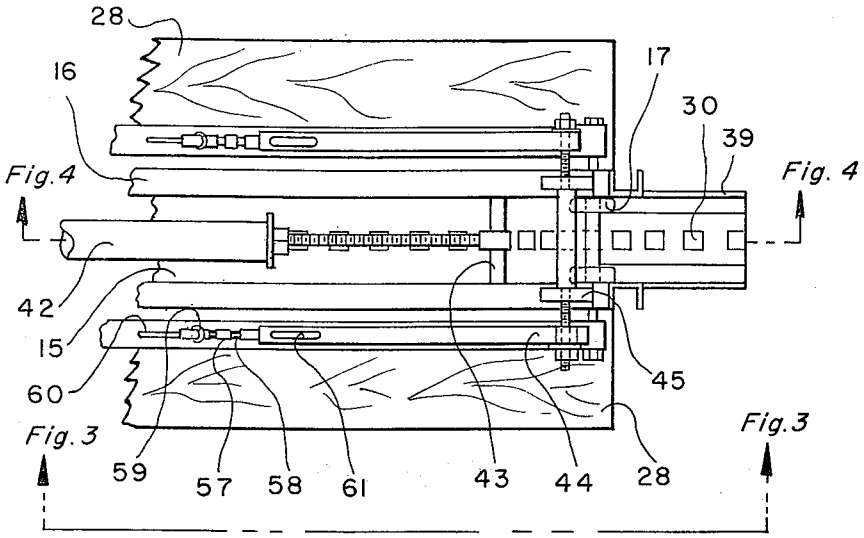
FIG. 2 is a top view of a portion of the form positioning apparatus of the present invention.
Figure 3:
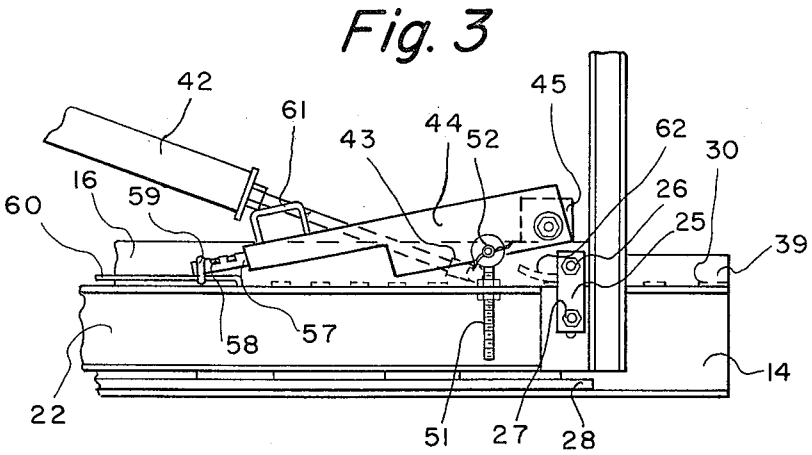
FIG. 3 is a side view of a portion of the form positioning apparatus of the present invention taken along the line 3—3 of FIG. 2.

In accordance with the present invention, as shown generally in FIG. 1 and in detail in FIGS. 2, 3 and 5, the utilization of the wedges to create the compression force between the movable beam and compression beam have been eliminated. Instead, a pair of compression levers 44 and positioned at either end of each moving beam 16. As best seen in FIG. 5, a support block 45 is welded upon the upper outer end of each moving beam 16. A hollow spacer 47 is positioned between the two supporting blocks 45 and an elongate axle 46 is passed through the spacer 47 and an aperture within the supporting block 45 and extends substantially on either side of the supporting blocks 45.

Each compression lever includes two apertures 48 through the side walls of the compression lever. In this manner, the compression lever 44 is pivotally supported upon the extended end of the axle 46 and held in place by means of a spacer 49 against the inner side wall of the compression lever and a nut 50 against the opposite wall.

A further aperture is positioned through the side walls of the compression lever 44 spaced a slight distance from the end apertures 48. A threaded eyebolt 51 is passed through an opening in the lower wall of the compression lever (not shown) and is secured between the two sidewalls by means of a pin 52 which passes through the eye of the eyebolt 51. The lower threaded end of the eyebolt 51 extends below the bottom wall of the compression lever 44 and through an aperture in the upper wall 53 of the compression beam 22. A pair of lock nuts 54 and 55 on either side of the upper wall 53 provide vertical adjustment and secure the lower portion of the eyebolt to the compression beam.

The opposite ends of each of the compression levers extend into a portion 56 of reduced cross section which ultimately terminates into an extended rod-like member 57. A plurality of recesses or indentations 58 are positioned along the upper surface of the rod-like member 57.

As best seen in FIG. 1, a pair of locking rings 59 are positioned around an elongate guide rail 60 which is positioned upon the upper surface 53 of each compression beam 22 at a point alongside the rod-like extensions 57 of both compression levers 44.

In use, the compression levers 44 may be raised or swung outwardly away from the compression beam 22 by means of handles 61 positioned thereon to thus retract the compression beam from the form panel by means of the pivoting action occurring out at the pivoted end of the compression lever. In a like manner, once a form panel is in place against the inner surface of the inner flange 14, the compression levers may be forced toward the compression beam with the effect of compressing the compression beam against the form panel. Once the compression levers are forced into place, they may be locked in place by means of sliding the locking ring 59 along the guide rail 60 over the rod-like member 57 until it is in engagement with a detent 58. The degree of force created by means of the compression levers greatly exceeds that of the wedges. Additionally, there is no risk of the compression levers prematurely releasing or danger of falling dislodged wedges.

Figure 4:
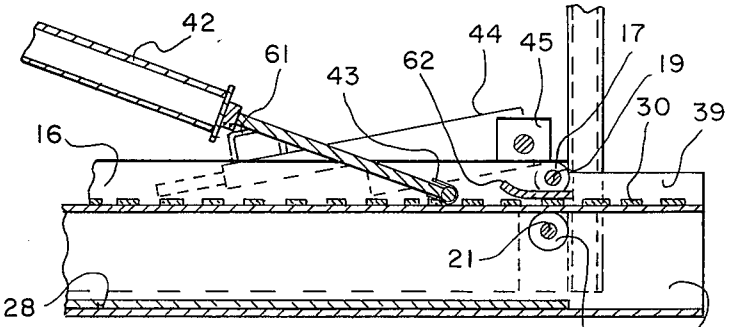
FIG. 4 is a side sectional view of a portion of the form positioning apparatus of the present invention taken along the line 4—4 of FIG. 2.

Futher, in accordance with the present invention and as illustrated generally in FIG. 1 and in detail in FIG. 4, a curved dog compression plate 62 is positioned under the spacer 20 and welded to the spacer. The thickness of the compression plate 62 is approximately the distance between the under surface of the spacer 20 and the top surface of the dog 30. As previously discussed, when the beam is deflected in the concave mode, the deflecting pressure will be downwardly upon the movable beams 16 and thus upon the upper rollers 17 against the upper surface of the upper or outer flange 15.

The positioning of the movable beams 16 and the axle 19 supporting the rollers 17 is such that, each time the movable beams are jacked one dog space along the jacking beam 10, the spacer 20 will be aligned directly overtop of a jacking dog 30. Accordingly, since the beam is deflected only when it is in a locked position with respect to a given dog, the deflection forces in the convex deflection mode will always be transmitted through the spacer 20, dog compression plate 62 directly onto a jacking dog 30 which is aligned with the web 63 of the jacking beam.

As may be best seen in FIG. 4, the forward end of the jacking dog 62 is curved upwardly or away from the upper surface of the jacking dog. This aids in permitting the dog compression plate to move off of one jacking dog and upwardly onto the next without catching on the edge of the jacking dog. If desired, the compression plate may be curved upwardly at each end.

In a particular embodiment, it may be desirable to have the thickness of the jacking dog be slightly in excess of the distance between the upper surface of the jacking dog and the spacer 20. If this condition occurs, the compression dog will ride up on a jacking dog 30 and positively space the rollers 17 from the upper surface of the outer flange 15 of the jacking beam.

The improvements to the form positioning apparatus of the present invention have been described in respect to particular embodiments thereof shown in the drawings and described in the specification. However, it is to be appreciated that other variations and modifications of the improvements of the present invention will now become apparent to those skilled in the art by reason of the foregoing description of a specific embodiment thereof. Accordingly, it is to be understood that the scope of the claims is not to be interpreted in respect to the particular embodiments thereof shown, but is to be interpreted in view of the appended claims.

I claim:

1. In form positioning apparatus used for securing flat forms in place for continuous sequential pouring of concrete walled structures of the type utilizing an extended jacking I beam having its inner flange secured to the wall and its outer flange providing the support for a pair of moving beams which, in turn, support cooperating compression beams working through wedges to maintain a compression force against a form placed against the inner surface of the inner flange, the improvements eliminating the wedges comprising:

at least one compression lever for each pair of moving and compression beams pivotally connected to one beam and interacting with the other beam to provide the compression force between the compression beam and the form.

2. In form positioning apparatus of the type used for securing flat form in place for continuous sequential pouring of concrete walled structures of the type utilizing an extended jacking beam having a centrally disposed series of jacking dogs; a pair of moving beams carried by opposed rollers including a common axle between the top roller pair; and beam deflecting means interacting upon the moving beams through the rollers to deflect the beam to the required wall curvature; the improvements preventing cracking of the beam flange comprising:

a dog compression plate approximately equal to the distance between the axle and the dog, whereby, upon beam deflection, the deflecting force will be placed upon the dog rather than upon the rollers.

3. The apparatus of claim 2 wherein the dog compression plate is curved upwardly at each end to aid in passing of the dog compression plate over the dogs upon the moving beam moving along the jacking beam.

* * * * *